US009175364B2

(12) United States Patent
Porto Pimenta et al.

(10) Patent No.: US 9,175,364 B2
(45) Date of Patent: Nov. 3, 2015

(54) ORE FINE AGGLOMERATE TO BE USED IN SINTERING PROCESS AND PRODUCTION PROCESS OF ORE FINES AGGLOMERATE

(75) Inventors: Hamilton Porto Pimenta, Belo Horizonte-Minas Gerais (BR); Flavio De Castro Dutra, Belo Horizonte-Minas Gerais (BR)

(73) Assignee: VALE S.A., Rio de Janeiro (BR)

( * ) Notice: Subject to any disclaimer, the term of this patent is extended or adjusted under 35 U.S.C. 154(b) by 369 days.

(21) Appl. No.: 12/948,269

(22) Filed: Nov. 17, 2010

(65) Prior Publication Data

US 2011/0232420 A1 Sep. 29, 2011

Related U.S. Application Data

(60) Provisional application No. 61/262,005, filed on Nov. 17, 2009.

(51) Int. Cl.
*C22B 1/16* (2006.01)
*C22B 1/243* (2006.01)
*C22B 1/244* (2006.01)

(52) U.S. Cl.
CPC . *C22B 1/243* (2013.01); *C22B 1/16* (2013.01); *C22B 1/244* (2013.01)

(58) Field of Classification Search
CPC ..... C22B 1/16
USPC ..... 75/228
See application file for complete search history.

(56) References Cited

U.S. PATENT DOCUMENTS

| | | | | | |
|---|---|---|---|---|---|
| 2,771,355 | A * | 11/1956 | Cohen | 75/458 |
| 2,915,378 | A * | 12/1959 | Brennan | 75/322 |
| 3,185,564 | A * | 5/1965 | Perry | 75/321 |
| 3,266,887 | A * | 8/1966 | Kramer et al. | 75/314 |
| 6,293,994 | B1 * | 9/2001 | Field et al. | 75/772 |
| 8,246,722 | B2 * | 8/2012 | Viloria et al. | 95/136 |
| 2003/0041693 | A1 * | 3/2003 | Roe | 75/758 |
| 2007/0119563 | A1 * | 5/2007 | Schmitt et al. | 164/528 |

FOREIGN PATENT DOCUMENTS

WO WO 2007123512 A1 * 11/2007

* cited by examiner

*Primary Examiner* — Jessee Roe
*Assistant Examiner* — Christopher Kessler
(74) *Attorney, Agent, or Firm* — Arent Fox LLP

(57) ABSTRACT

An ore fine agglomerate to be used in a sintering process is disclosed, wherein the ore fine agglomerate is formed by a mixture of ore fine particles and an agglomerating agent, and wherein the particles have diameters between 0.01 mm and 8.0 mm. A production process of ore fines agglomerate is disclosed comprising the steps of using ore fine particles with a granulometry lower than 0.150 mm, mixing the ore fine particles with an agglomerating agent in a ratio of 0.5 to 5.0% by mass of sodium silicate, forming wet particles with diameters between 0.01 mm and 8.0 mm with an addition of water, and drying the wet particles at a temperature varying from 100° C. and 150° C. to form dry particles that are resistant to mechanical efforts and the elements.

11 Claims, 1 Drawing Sheet

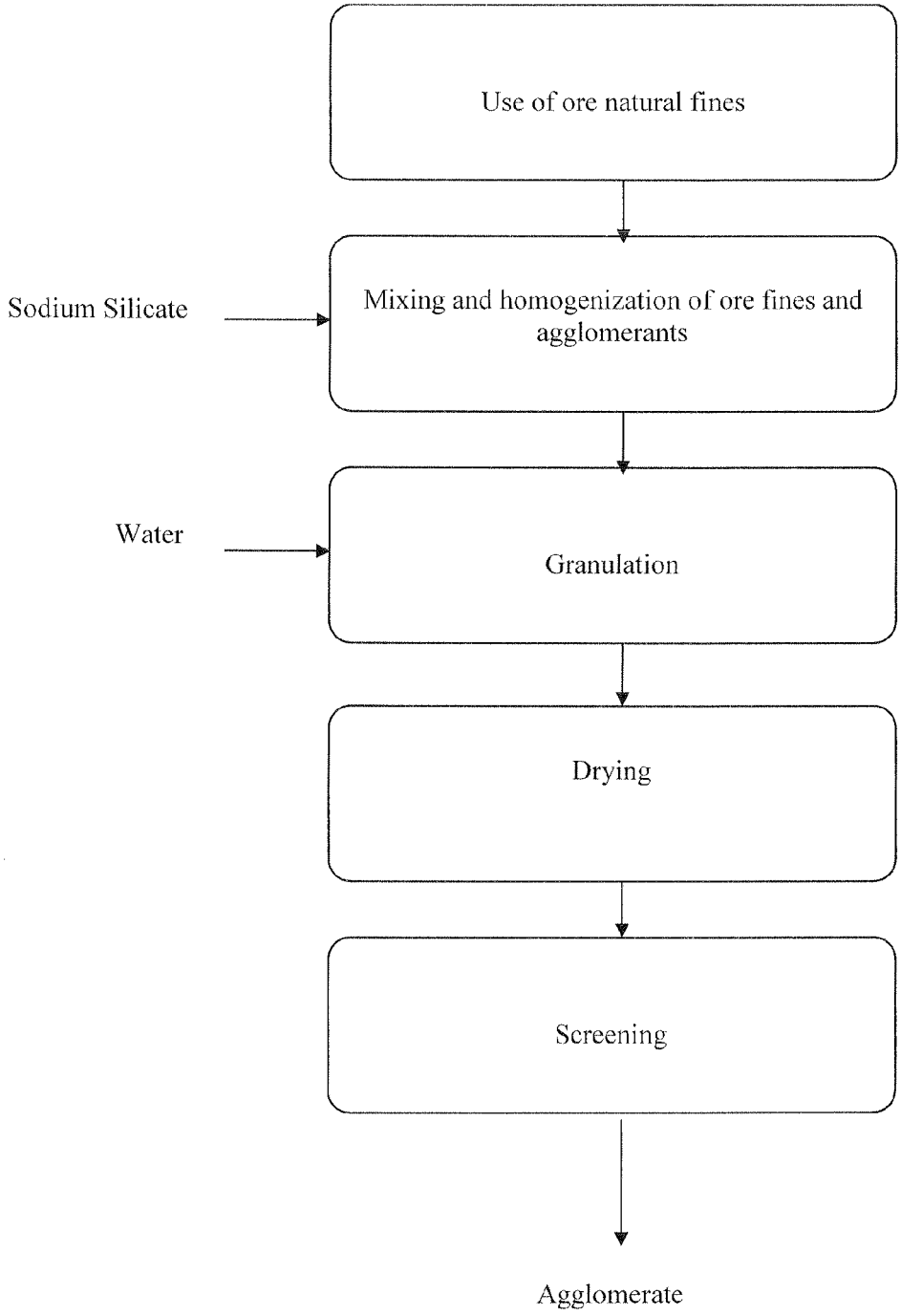
Use of ore natural fines
Sodium Silicate
Mixing and homogenization of ore fines and agglomerants
Water
Granulation
Drying
Screening
Agglomerate

ORE FINE AGGLOMERATE TO BE USED IN SINTERING PROCESS AND PRODUCTION PROCESS OF ORE FINES AGGLOMERATE

This application claims priority from U.S. Patent Application No. 61/262,005, filed on Nov. 17, 2009, titled "Production Process of Ore Fine Agglomerates and Curing at Low Temperatures for Use with Sintering Industrial Process," which is incorporated herein by reference in its entirety.

BACKGROUND OF THE INVENTION

1. Field of Invention

Aspects of the present invention relate to ore fines agglomerate to be used in a sintering process, the agglomerate comprising a diameter between 0.01 mm and 8.0 mm, produced from natural ore fines and sodium silicate as main agglomerant and at low temperature curing. Aspects of this invention also relate to a process of production of ore fines agglomerates to be used in sintering processes.

2. Description of Related Art

Several technologies of cold ore agglomeration are known by the prior art. These technologies are based on the agglomeration of ore fines using basically, cements, mortars, organic agglomerants and carbonated residues as agglomerant agents. In these acknowledged agglomeration processes, the fines used need to undergo a milling stage so that it may feature adequate granulometry for the agglomeration, being that this unit operation requires appropriate equipment and energy.

Besides that, several additives, associated to these agglomerants, are added in order to accelerate the cure of agglomerates and improve its mechanical properties. The use of several agglomerants and additives, in addition to make the dosage system more complex, it also hampers the reduction of operational cost and the agglomerate quality control.

Other technologies for residues agglomeration known by the prior art and used in the steel mill and metallurgy industry use the sodium silicate, among other additives, to accelerate the curing process of the agglomerates, however, in this case, the obtained agglomerates present diameters above 12 mm and are used as metallic load for reduction reactors.

Additionally, most of these processes use briquetting as unit transformation operation, that is, the fines used in these processes also require to undergo a conformation stage so that it may display an adequate granulometry for the agglomeration.

Therefore, in general, the agglomerates obtained from these processes known by the prior art present the need of high dosage of agglomerants (above 10%) and high time for the curing of the product (more than ten days for curing time). Furthermore, the traditionally used agglomerants are expensive and represent more than 70% of the operational cost of transformation of the fines in agglomerates, resulting in high production costs.

Further, the agglomerates resulting from these processes present low resistance to water contact, high generation of fines during transportation and handling (low mechanical resistance) and high generation of fines due to thermal shock inside the reduction reactors. Most of the times, the agglomerated product presents contamination by elements that are deleterious to the operation of metallurgic reactors, besides the high transformation cost. The low resistance to water contact refers to the fact that these agglomerants are not completely insoluble and its fragility to thermal shock may be related to the chemical and physical stability of the agglomerant.

Production process of agglomerates to be used in sintering process, with diameter between 0.01 mm and 8.0 mm, produced from ore natural fines and sodium silicate as main agglomerant, and curing at low temperature, is not mentioned in the prior art.

SUMMARY OF THE INVENTION

It is an object of the present invention to provide ore fines agglomerate comprising a diameter between about 0.01 mm and about 8.0 mm and formed from ore natural fines and sodium silicate based agglomerant, without the requirement of the milling stage or any other type of comminution.

Another object of this invention is to provide ore fine agglomerate that does not require high temperatures for curing stage.

Another object of the present invention is to provide ore fine agglomerate that comprising low levels of contamination by $Na_2O$, high mechanical resistance and high water contact resistance.

It is also an object of this invention to provide a process to produce ore fines agglomerates in which the milling stage or another type of comminution is not required.

It is also another object of this invention to provide a process for production of ore fines agglomerates that use only one type of agglomerating agent in the stage of mixing and short time for curing in the drying stage, decreasing the demand for energy and production cost.

Therefore, the invention consist of an ore fine agglomerate to be used in sintering process, which is consisted of a mixing of ore natural fines associated to an agglomerant agent, and comprises diameter between about 0.01 mm and about 8.0 mm.

The invention also consists of a production process of ore fines agglomerate, comprising of the following steps:

(i) Use of ore natural fines with granulometry lower than about 0.150 mm;

(ii) Mixing of ore natural fines with an agglomerating agent in the proportion ratio of about 0.5 to about 5.0% of agglomerant agent mass;

(iii) Granulation of the mixing with controlled addition of water forming agglomerates with diameter between about 0.01 mm and about 8.0 mm; and (iv) Drying of moist agglomerates at a temperature variation between about 100° C. and about 150° C. forming dry agglomerates.

BRIEF DESCRIPTION OF THE DRAWINGS

The present invention will be described in more details further below based on the example of execution represented in the drawings. The FIGURE shows:

FIG. 1—a flowchart of the ore fines agglomerate production process, object of the present invention.

DETAILED DESCRIPTION OF THE INVENTION

The subject matter of the present invention is an ore fines agglomerate to be used in sintering processes. This agglomerate comprises a diameter between 0.01 mm and 8.0 mm, simply referred to as agglomerate and is produced from a mixing of ore natural fines that present granulometry smaller than 0.150 mm, associated to an agglomerant agent, in a process of granulation that might be pelleting or another equivalent process.

As previously mentioned, the ore fines used in the formation of this agglomerate are the ore natural fines, that is, the particles of low granulometry, without the requirement for milling or other procedures of comminution in order to obtain it within the desirable granulometric range.

The ore fines to which this invention refers to are preferably the iron ore natural fines, however, other minerals such as manganese, nickel and others may also be used.

The agglomerant agent of the mixing with the iron ore natural fines is sodium silicate, added to the range of 0.5 to 2.5% mass in solid state (powder) or 1.5 to 5.0% mass in liquid state. That is, this sodium silicate may be added both in solid or liquid form.

Besides the agglomerant agent, it is also added additive to the mixture. These additives consist of manioc starch added in the range of 0.5 to 1.0% by mass and microsilica added in the range of 0.3 to 1.0% by mass.

The function of the additives added to the sodium silicate is to improve the quality of the agglomerate. In this sense, the starch increases the resistance to generation of fines by agglomerate abrasion, for example, by friction during handling and transportation that generates the release of fine particles, and the microsilica may replace part of the sodium silicate without diminishing the mechanical resistance of this agglomerate.

The curing or drying of the agglomerate formed by the mixing of ore natural fines, agglomerant agent and additives is performed at low temperature, in the range of 100° C. to 150° C., for 3 to 20 minutes. This drying may be performed in rotating furnace, moving grill furnace or drying/granulate horizontal fluidized bed furnace. In this way, the agglomerate, subject of the present invention presents curing or fast drying, which does not require high temperatures, representing, therefore, a lower energetic cost.

It is also a purpose of this present invention, a process of production of ore fines agglomerates, comprising of the following steps:

(i) Use of ore natural fines with granulometry lower than 0.150 mm;

(ii) Mixing of ore natural fines with agglomerant agent in the proportion ratio of 0.5 to 5.0% by mass;

(iii) Granulation of the mixing with controlled addition of water forming agglomerates with diameter between 0.01 mm and 8.0 mm; and (iv) Drying of the moist agglomerates at a temperature varying between 100° C. and 150° C.

It is observed that the present process does not include comminution stage (milling, briquetting, triturating, etc.), since these natural fines have the adequate granulometry for the agglomeration and obtainment of agglomerates with diameters within desirable range.

The mixing stage is performed by a mixer or may be directly performed in a drying/granulate horizontal fluidized bed furnace.

In the route via mixer, it is added the agglomerant agent sodium silicate in liquid or solid state, and the additives are also added, consisting of manioc starch in the range of 0.5 to 1.0% by mass and microsilica in the range of 0.3 to 1.0% by mass. When the sodium silicate is added in the solid state (powder), the quantity varies between 0.5 to 2.5% by mass. When the addition of this sodium silicate is performed in liquid state, the quantity varies between 1.5 to 5.0% by mass.

These components are mixed for a period of time that varies between 5 and 10 minutes.

After the completion of the mixing of the fines with the sodium silicate and additives, the mixing undergoes granulation process that may be pelleting in disc type equipment or pelleting drum or another equivalent process, with controlled addition of water, forming the agglomerates with diameter between 0.01 mm and 8.0 mm.

In the route via drying/granulate horizontal fluidized bed furnace, the mixing is performed in the same proportions aforementioned, however, inside the reactor, which performs simultaneously the granulation and drying of the agglomerate.

After the drying stage one stage of screening for the removal of non-agglomerate fines may be considered and fines may return to the process in the granulation stage, with the purpose of increase the performance of the product in sintering processes.

After screening, the agglomerates in the desirable range size are selected and destined to commercialization.

The agglomerates drying or curing may be performed by a rotating furnace, moving grill furnace or drying/granulate horizontal fluidized bed furnace, at a temperature range of 100° C. to 150° C., for 3 to 20 minutes depending on the type and size of drying reactor used.

It is observed in this stage that necessary temperatures for the curing or drying of the agglomerate are considered low, if compared to the temperature applied in the process of prior art.

After the drying stage occurs the dry agglomerate screening stage. This screening is necessary for the controlling of the final product.

The agglomerate obtained from this process presents high mechanical resistance, both at dry as high moist conditions. This high resistance allows long distances transportation and handling until its final use. In addition to that, this agglomerate does not suffer any degradation by entering in contact with the rain water.

In the case of iron ore, the use of concentrated fines generates an agglomerate of high contents of iron and low contents of $SiO_2$, $Al_2O_3$ and P.

Tests performed as pilot sintering confirmed that the product reaches excellent performance, with significant gains to the process and to the quality of the sinter as, for instance, the increase in productivity, reduction of specific fuel consumption, high mechanical resistance, etc.

The agglomerates were assessed in five conditions, specified as follows:

1. In a typical sintering mixing it was replaced 20% of the fines of this mixing by 20% of the agglomerate object of this invention and then performed the measurement of the productivity results, consumption of fuel and mechanical resistance of the sintered final product. The obtained gains were: increase of 12% in productivity, reduction of 30% of fuel consumption and increase of 15% of the mechanical resistance of the final product.

2. In a typical sintering mixing it was replaced 13% of a coarse Australian ore by 13% of the agglomerate of the present invention and then performed the measurement of the productivity results, consumption of fuel and mechanical resistance of the sintered final product. The obtained gains were: increase of 9% in productivity, reduction of 5% of fuel consumption and increase of 12% of the mechanical resistance of the final product.

3. In a typical sintering mixing it was replaced 30% of a coarse Australian ore by 13% of the agglomerate of the present invention and then performed the measurement of the productivity results, consumption of fuel and mechanical resistance of the sintered final product. The obtained gains were: increase of 12% in productivity, reduction of 7.5% of fuel consumption and increase of 4% of the mechanical resistance of the final product.

4. In a typical sintering mixing it was replaced 30% of a coarse ore from Vale from this mixing by 30% of the agglomerate of the present invention and then performed the measurement of the productivity results, consumption of fuel and mechanical resistance of the sintered final product. The obtained gains were: increase of 20% in productivity, reduction of 4% of fuel consumption and sustainment of the mechanical resistance of the final product.

In this way, the agglomerate and the obtainment process of such agglomerate, subject of this invention, minimize some issues usually found in the cold agglomeration processing, such as: need of high dosage of agglomerants; high time for curing of product, low resistance to water contact, high production of fines during transportation and handling, high production of fine as a result of thermal shock and contamination by elements that are deleterious for the utilization of the product.

In addition to that, as previously observed, the process of this invention minimizes the need of dosing several types of agglomerants and, especially, the requirement of milling for granulometric adaptation of the ore. Therefore, it results in a greater simplicity of the agglomerant dosage system and obtainment of the ore fines for the pelleting stage.

The invention claimed is:

1. An ore fine agglomerate to be used in a sintering process, comprising:

ore fine particles, an agglomerating agent comprising sodium silicate, and microsilica as an additive in a range of 0.3% to 1.0% by mass, wherein a ratio of the ore fine particles and the agglomerating agent is about 0.5 to about 5.0% by mass of the agglomerating agent, and wherein the ore fine agglomerate has a diameter between about 0.01 mm and about 8.0 mm, and has cured at a temperature of about 100° C. to about 150° C. in about 3 to about 20 minutes.

2. The agglomerate according to claim 1, wherein the sodium silicate is in a solid state in a ratio of about 0.5 to about 2.5% by mass.

3. The agglomerate according to claim 1, wherein the sodium silicate is in a liquid state in a ratio of about 1.5 to about 5.0% by mass.

4. The agglomerate according to claim 1 comprising an additional additive formed of manioc starch in a range of about 0.5 to about 1.0% by mass.

5. The agglomerate according to claim 1 wherein the agglomerate is water resistant.

6. A method for the production of an ore fine agglomerate according to claim 1, comprising the steps of: using ore fine particles with a granulometry lower than 0.150 mm; mixing the ore fine particles with an agglomerating agent in a ratio of about 0.5 to about 5.0% by mass of sodium silicate; forming wet particles with diameters between about 0.01 mm and about 8.0 mm with an addition of water; and drying the wet particles at a temperature varying from about 100° C. and about 150° C. to form dry particles.

7. The method according to claim 6, wherein the agglomerating agent is sodium silicate in a solid state in an amount of about 0.5 to about 2.5% by mass.

8. The method according to claim 6, wherein at the agglomerating agent is sodium silicate in liquid state in an amount of about 1.5 to about 5.0% by mass.

9. The method according to claim 6, wherein during the mixing, an additive consisting of manioc starch in a range of about 0.5 to about 1.0% by mass and microsilica in a range of about 0.3 to about 1.0% by mass is added.

10. The method according to claim 6, wherein forming the wet particles is performed using a disc, pelleting drum or inside a drying/granulate horizontal fluidized bed furnace.

11. The method according to claim 6, further comprising screening the dry agglomerates.

* * * * *